US007528555B2

(12) United States Patent
Gater

(10) Patent No.: US 7,528,555 B2
(45) Date of Patent: May 5, 2009

(54) LED CONTROLLER IC USING ONLY ONE PIN TO DIM AND SET A MAXIMUM LED CURRENT

(75) Inventor: Christian Gater, Dunblane (GB)

(73) Assignee: Micrel, Inc., San Jose, CA (US)

( * ) Notice: Subject to any disclaimer, the term of this patent is extended or adjusted under 35 U.S.C. 154(b) by 93 days.

(21) Appl. No.: 11/832,321

(22) Filed: Aug. 1, 2007

(65) Prior Publication Data

US 2009/0033243 A1 Feb. 5, 2009

(51) Int. Cl.
*G05F 1/00* (2006.01)

(52) U.S. Cl. ..... 315/291; 315/307; 315/308

(58) Field of Classification Search ..... 315/291; 362/800

See application file for complete search history.

(56) References Cited

U.S. PATENT DOCUMENTS 6,836,081 B2 12/2004 Swanson et al.

2007/0216320 A1* 9/2007 Grivas et al. ..... 315/291

* cited by examiner

*Primary Examiner*—Douglas W Owens
*Assistant Examiner*—Jianzi Chen
(74) *Attorney, Agent, or Firm*—Patent Law Group LLP; Brian D. Ogonowsky

(57) ABSTRACT

An LED driver IC is described that uses a single pin to both set the maximum current through one or more driven LEDs and variably control the brightness of the LEDs. A single resistor is connected to the control pin of the IC, where the value of the resistor sets the maximum current through the LEDs. A PWM source, outputting a pulse train at a particular duty cycle, is connected to the other end of the resistor, where the duty cycle controls the LED brightness level. When the PWM signal is low (e.g. ground), a sample and hold circuit connects the output of a feedback control voltage to an Imax current source to set a maximum current based on the external resistor value. An inverse of the duty cycle of the PWM controller controls a current Idim that is subtracted from the maximum current Imax set by the resistor. This difference current is used to control drivers for the LEDs.

21 Claims, 5 Drawing Sheets

LED CONTROLLER IC USING ONLY ONE PIN TO DIM AND SET A MAXIMUM LED CURRENT

FIELD OF THE INVENTION

This invention relates to light emitting diode (LED) drivers and, in particular, to a driver that sets a maximum current through one or more LEDs and also variably controls the brightness of the LEDs.

BACKGROUND

LEDs are typically driven by a current source. LEDs are usually characterized by the manufacturer as having a certain brightness level at a maximum rated current. Any current exceeding this maximum rated current may reduce the reliability of the LED or damage it. Accordingly, LED driver designers sometimes include a means for the customer to set the maximum current delivered to an LED, since the driver may be used with a variety of types of LED.

LED drivers also typically enable the user to control the brightness level of the LED by controlling the continuous current level or controlling the average current level. The average current level can be controlled by controlling the duty cycle of current pulses to the LEDs. When controlling the brightness using pulses of current, such as by pulse width modulation (PWM), the pulses are optimally the maximum rated current, or close to such current, so that at 100% duty cycle the maximum brightness is achieved.

FIG. 1 illustrates one type of LED driver as a packaged integrated circuit 10. Assuming the IC 10 can drive up to three LEDs 12, the IC 10 includes one current source per LED 12. Each current source is connected to ground, assuming the positive voltage supply is connected to the anodes of the LEDs. To set the maximum current through the LEDs when the LEDs are controlled to have maximum brightness, the user selects a certain resistor 14 value. The data sheet for the IC 10 contains a formula or table for correlating the resistor 14 value to the maximum LED current. One end of the resistor 14 is connected to a fixed voltage reference, which may even be ground, and the other end is connected to a pin 16 of the IC 10. The IC 10 includes other pins, such as for power, ground, and enable. The voltage drop across the resistor 14 during operation of the IC 10, determined at least in part by the resistor 14 value, is then used by the IC 10 to set the maximum current through the LEDs 12.

A second pin 18 of the IC 10 receives a control signal related to the desired brightness of the LEDs. The control signal may be an analog signal that controls the duty cycle of an internal PWM controller, or the control signal may be the PWM pulse train itself, or the control signal may control the continuous current applied to the LEDs 12 by some other method.

It is desirable to reduce the pin count of driver ICs, both for reducing the cost of the IC and for simplifying the customer's application of the IC.

FIG. 2 illustrates another prior art driver IC approach, similar to that shown in U.S. Pat. No. 6,836,081, where the values of external resistors 20, 21, and 22 are selected by the user to directly control the maximum currents through the LEDs (higher resistance value causes lower maximum current). A dimming control signal applied to pin 24 of IC 26 controls the continuous or average current through the LEDs for brightness control, as described with respect to FIG. 1. Although the technique of FIG. 2 requires the IC 26 to have only one pin for the current control, the technique has the drawback of requiring the user to employ three resistors in the output circuit, which incurs extra cost and board space penalties.

What is needed is a single pin technique for an LED driver IC, where the single pin is used to both set the maximum current through the one or more driven LEDs and variably control the brightness of the LEDs.

SUMMARY

An LED driver IC is described that uses a single pin to both set the maximum current through one or more driven LEDs and variably control the brightness of the LEDs. Setting a maximum current is sometimes referred to as calibrating.

A single resistor is connected to a control pin of the IC, where the value of the resistor sets the maximum current through the LEDs. A PWM controller, outputting a pulse train at a particular duty cycle, is connected to the other end of the resistor, where the duty cycle controls the LED brightness level. The frequency of the pulses is typically greater than 100 Hz.

When the PWM signal is low (e.g. ground), a feedback current source internal to the IC drops a certain voltage across the resistor, where the voltage drop is related to the resistance value. This voltage drop is applied to an error amplifier, whose output controls the current source to maintain the voltage drop at a predetermined level (e.g., equal to a reference voltage). While the PWM signal is low, a sample and hold circuit connects the output of the error amplifier to a control terminal (e.g. a gate) of a second current source to supply the maximum rated current to the LEDs. Prior to the PWM signal going high, the sample and hold circuit isolates the second current source from the PWM circuit and "holds" the control voltage so that the second current source outputs a continuous maximum current for the remainder of the cycle.

When the PWM signal is high, the voltage drop across the resistor is irrelevant to the maximum current since it does not affect the current generated by the second current source.

Independent of setting the maximum current, a voltage proportional to the inverse of the duty cycle is output by a low pass filter. The low pass filter averages an inverted PWM signal. This average voltage drives a sinking or dimming current source that sinks (subtracts) some of the "maximum current" from the second current source, depending on the duty cycle. The resulting difference current is converted to a control voltage for the LED driver current sources. So, the current applied to each LED is a continuous current, where the maximum PWM duty cycle causes the sink current to be a minimum. Any decrease in the duty cycle increases the sink current and reduces the drive signal to the LED drivers. In this way, both the maximum current and the brightness control is controlled using only one pin of the IC.

There are various circuit techniques that may be used to perform the inventive technique of setting the maximum current during a particular state of a PWM controller, where the PWM controller is used to control the LED brightness, and where only one pin is used for both functions.

BRIEF DESCRIPTION OF THE DRAWINGS

Elements labeled with the same numeral may be equivalent or identical.

DETAILED DESCRIPTION

Figure 1:
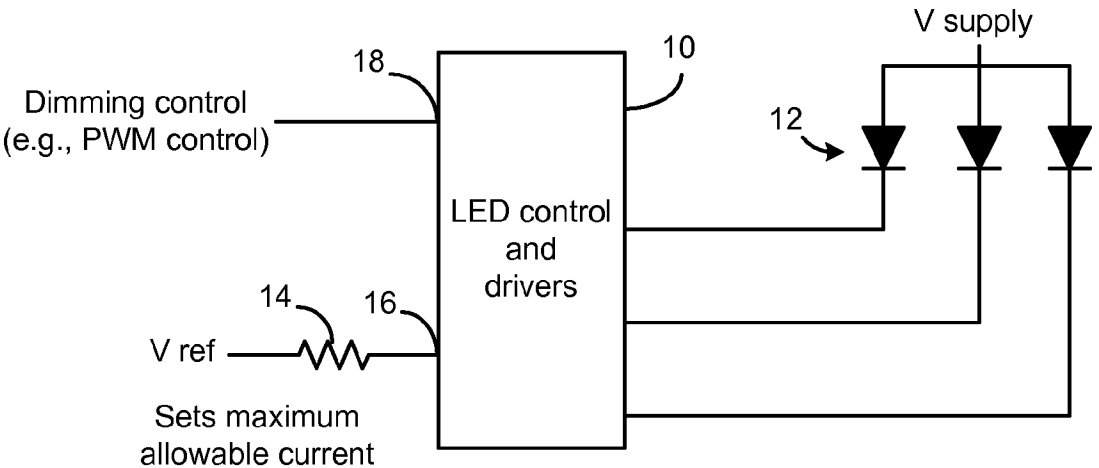
Fig. 1 (prior art)
FIG. 1 illustrates a prior art LED driver IC using one pin for controlling the LED brightness and another pin for setting the maximum current.
Figure 2:
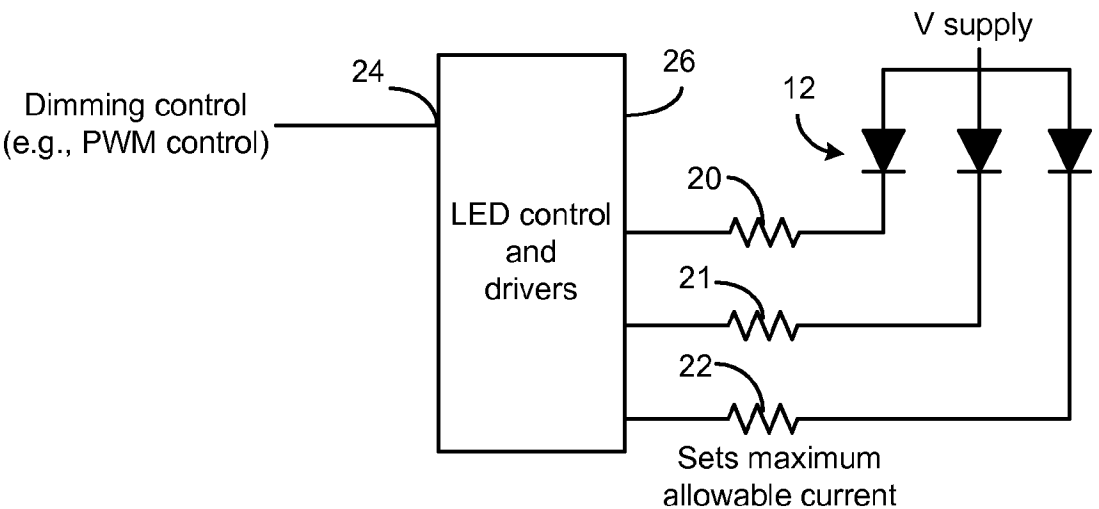
Fig. 2 (prior art)
FIG. 2 illustrates another prior art LED driver IC where one pin is used for controlling the LED brightness, and the maximum current is set by the value of a high-current resistor per LED at the output.

The LED driver IC of the present invention will be described with respect to FIGS. 3 and 4. The IC 30 package includes one pin 32 for both setting the maximum current through the LEDs 12 and for controlling the brightness of the LEDs. The IC 30 package also includes pins 33-35 for connection to the cathodes of the LEDs 12. In another embodiment, the components of the IC driver may be selected so that the pins 33-35 are connected to the anodes of the LEDs 12, and the cathodes are directly connected to ground.

Additional pins (not shown) on the IC 30 package are connected to the supply voltage and to ground.

A conventional external PWM source 36 outputs a pulse train having a frequency typically between 100 Hz-1 MHz, where the duty cycle (ratio of on time versus total time) determines the brightness levels of the LEDs 12. An oscillator internal to the PWM source 36 determines the frequency. Varying a control signal 38 into the PWM source 36 varies the duty cycle. The control signal 38 may be a variable resistance, a DC voltage, or any other suitable signal, depending on the particular PWM source used. In one embodiment of a conventional PWM source, the control signal 38 sets a voltage level that is compared to a ramping output of the oscillator. When the ramp crosses the voltage, as determined by a comparator, the PWM source output goes low until the beginning of the next oscillator cycle.

A resistor 40 (Rset) is connected in series between the PWM source 36 and the pin 32.

Pin 32 is also connected to the non-inverting input of a differential amplifier 42, which acts as an error amplifier. The inverting input of the amplifier 42 is connected to a fixed reference voltage (V ref). The output of the amplifier 42 is connected to the gate of a PMOS transistor 44 (FIG. 3) that acts as a current source Iset (FIG. 4).

Figure 3:
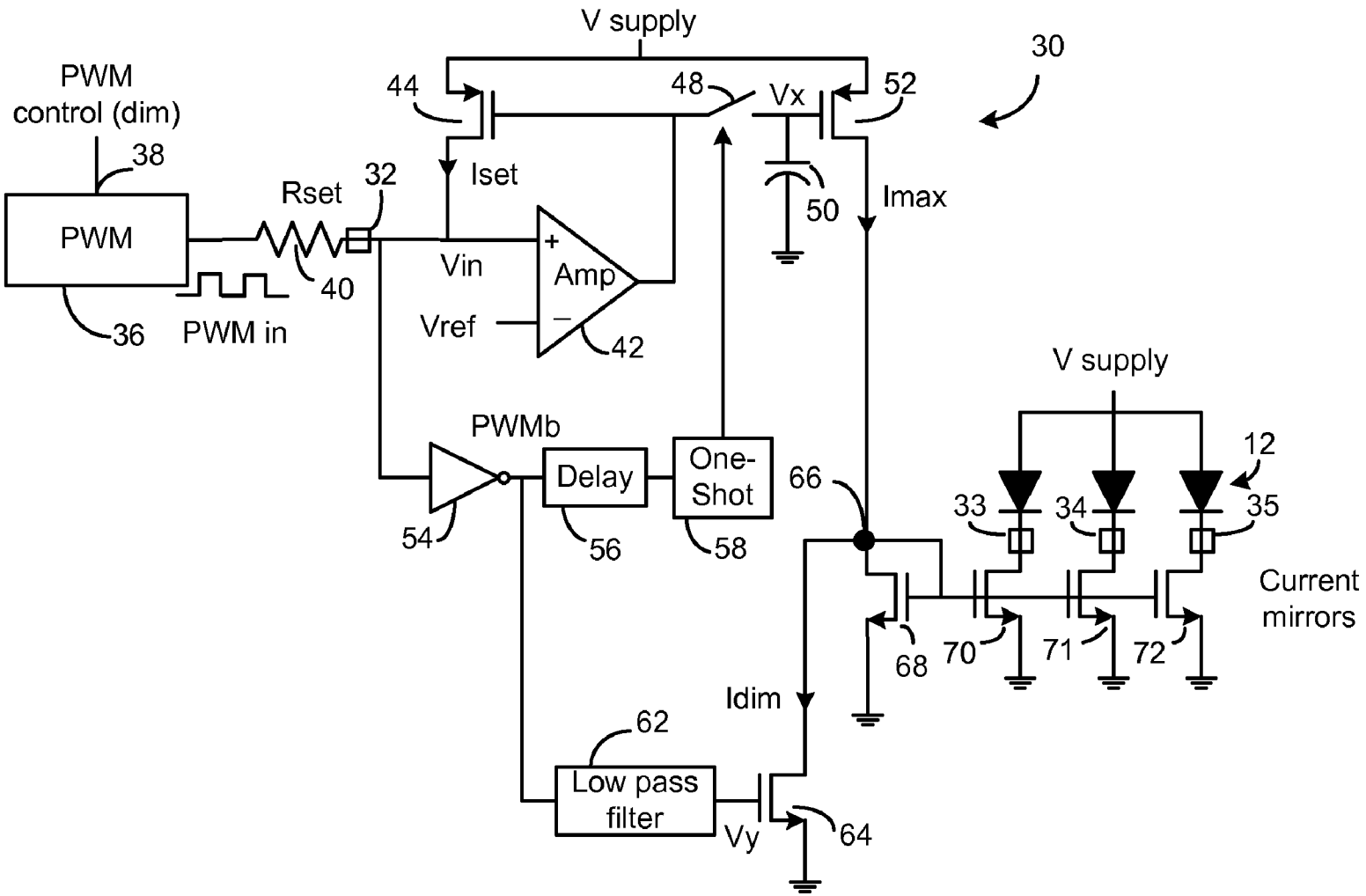
FIG. 3 is a diagram illustrating one embodiment of the invention.
Figure 4:
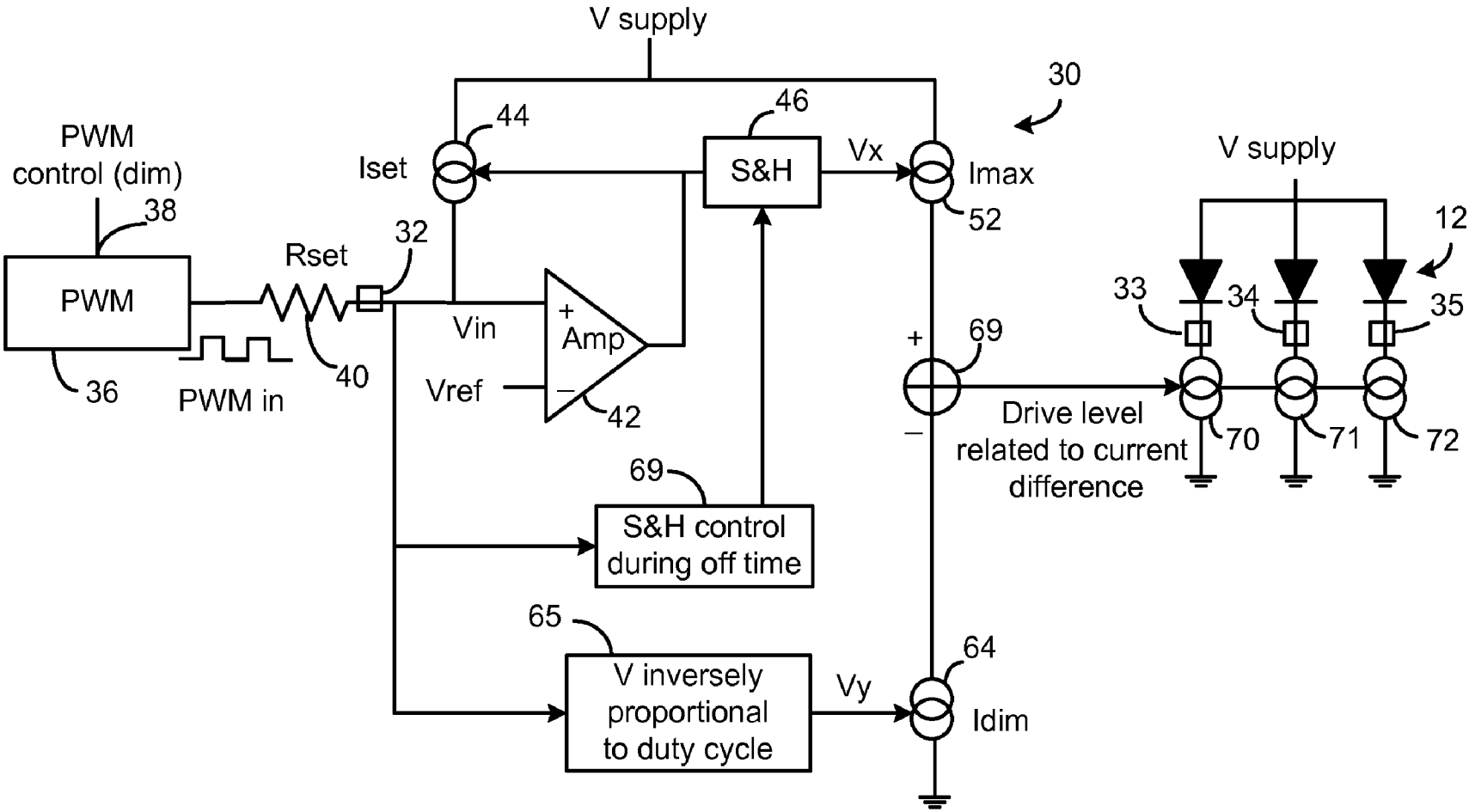
FIG. 4 illustrates a more generic embodiment of the invention illustrating the functions of the various components.

The output of the amplifier 42 is also connected to a switch terminal of a sample and hold circuit 46 (FIG. 4). FIG. 3 illustrates one embodiment of a sample and hold circuit. In FIG. 3, the temporary closing of a switch 48 (e.g., an MOS transistor) charges a capacitor 50 to the amplifier 42 voltage. When the switch 48 is then opened, the voltage level is held by the capacitor 50.

The held voltage at capacitor 50 is applied to the gate of a PMOS transistor 52 (FIG. 3) that acts as a current source Imax (FIG. 4). Since transistors 44 and 52 have their sources coupled to the voltage supply and have the same gate voltage during the sampling time, they act as current mirrors during the sampling time. Their relative currents are determined by their respective gate sizes.

Pin 32 is connected to an inverter 54 (FIG. 3), which inverts the PWM source 36 signal. The output of the inverter 54 is labeled PWMb. Therefore, when the PWM source 36 outputs a low state (e.g., ground), this low state is inverted by the inverter 54, and the inverter 54 outputs a high signal (e.g., V supply). The inverter 54 preferably has hysteresis for stability. Such an inverter is also known as a Schmitt inverter. An optional delay circuit 56 delays the high signal output from the inverter 54 for a short time to ensure all other levels in the circuit are stable after the PWM signal goes low. The high signal output from the delay circuit 56 then triggers a one-shot circuit 58 to output a very short pulse of a fixed duration. This sampling pulse closes the switch 48 to charge capacitor 50 to the amplifier 42 output voltage then opens the switch 48 to hold the voltage until the next cycle. The sample and hold control circuit is shown as block 60 in FIG. 4. The capacitor 50 should be small, and the one-shot pulse should be very short, since the entire sampling must occur during the shortest possible low state of the PWM source 36. Therefore, the maximum duty cycle of the PWM source cannot be 100%, but may be 99% or another suitable maximum.

The operation of the IC 30 in setting the maximum current through the LEDs 12 will now be described, followed by controlling the LED brightness by the duty cycle.

Setting the maximum current is only performed when the PWM source 36 outputs a low level, since sampling of the amplifier 42 voltage only occurs when the PWM signal is low. When the PWM signal is low (ground), virtually all the current through the Iset transistor 44 flows through the resistor 40 to cause the voltage on pin 32 to be Iset*Rset. This voltage is applied to the non-inverting input of the amplifier 42, and the output of the amplifier 42 controls the current through the transistor 44 in order to make the voltage at pin 32 to be substantially Vref. Hence, the control voltage for the Iset transistor 44 is set based on the value of the resistor 40.

Figure 5:
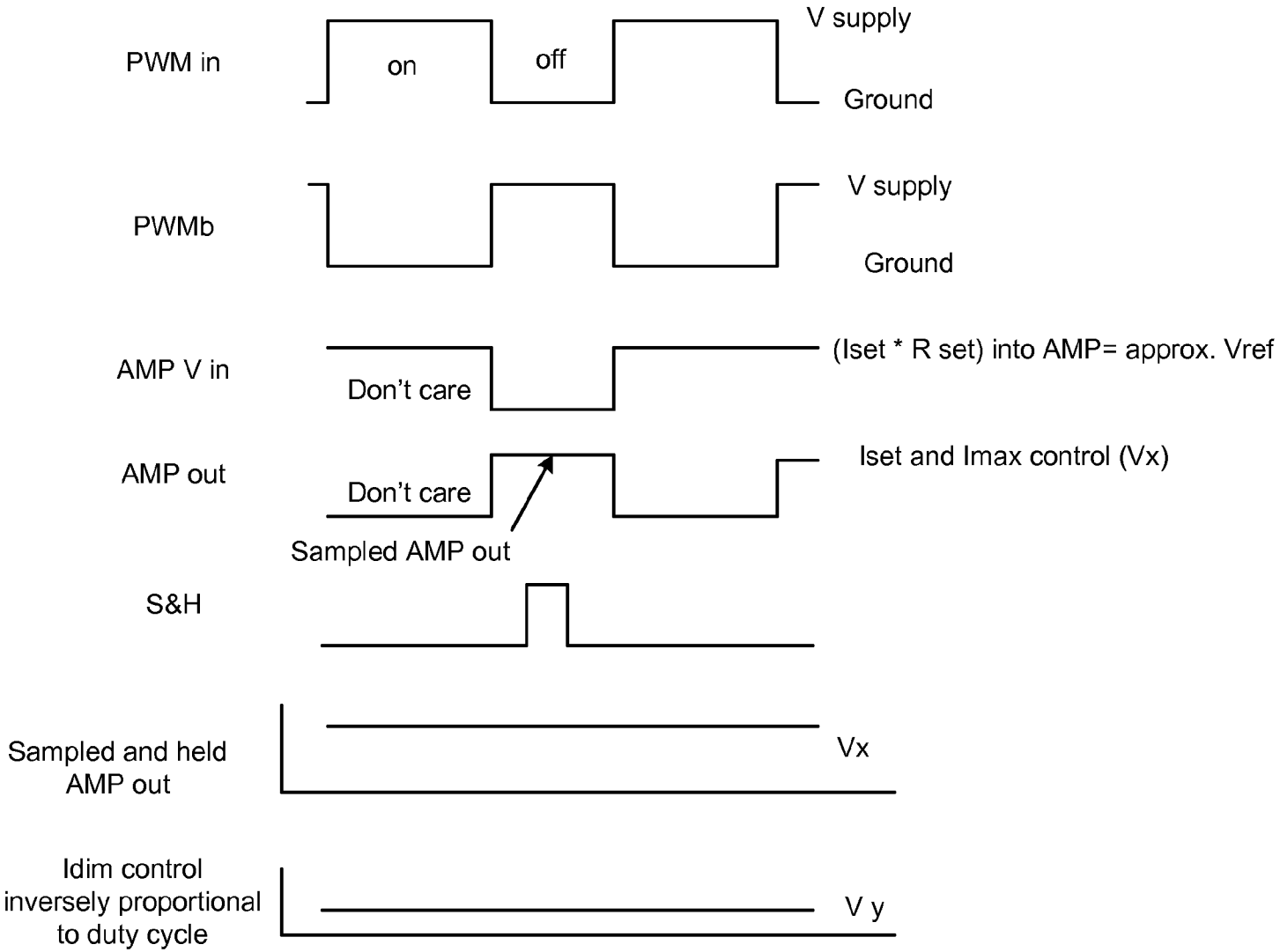
FIG. 5 shows examples of the voltage levels at certain nodes in the circuits of FIGS. 3 and 4.

This same control voltage for the Iset transistor 44 is coupled to the Imax transistor 52 during the sampling time, so the current through transistor 52 mirrors the current through transistor 44 during the sampling time. After the sampling time, the control voltage to transistor 52 is held by the capacitor 50. The constant current through transistor 52 sets the maximum current through the LEDs 12, more fully explained below. In the graphs of FIG. 5, the sampled and held voltage at the output of the amplifier 42 (AMP out) is labeled Vx.

During the time that the PWM signal is high, there is no sampling of the amplifier 42 output, so the operation of the amplifier 42, transistor 44, and resistor 40 is not relevant during those times.

The system could also work in reverse with the current calibration occurring when the PWM signal is high (e.g. Vref), and brightness increases with an increase in the low time of the PWM signal. In such a case, the duty cycle would be determined by the percentage of the low time versus the total time. Hence, an increased duty cycle still increases the brightness. The appropriate control signals in the system would be inverted.

The brightness control of the LEDs 12 will now be described.

The inverted pulse train output by the inverter 54 is applied to a low pass filter 62 (FIG. 3), which averages the PWM source's inverted high and low levels to create a voltage whose magnitude is inversely proportional to the duty cycle of the main PWM input. This voltage is identified as Vy in the various figures. The voltage Vy is applied to the gate of an NMOS transistor 64 (FIG. 3), which is a current source conducting a variable current Idim. There are various ways to generate a voltage inversely proportional to the duty cycle, and FIG. 4 generically shows such circuits as block 65. A bias circuit (not shown) may be employed to set a DC bias of transistor 64 or any other component if necessary.

The Idim current, determined by the PWM duty cycle, is subtracted from the Imax current at node 66. The excess current from Imax flows through the NMOS transistor 68. Since the drain of transistor 68 is tied to its gate, the gate voltage is automatically adjusted to cause transistor 68 to conduct the difference current. There are various circuit techniques that can generate a drive voltage related to a difference current and such circuits are generically shown in FIG. 4 as circuit 69.

High current driver NMOS transistors 70, 71, and 72 are controlled by the same gate voltage to transistor 68, and the sources of transistors 68 and 70-72 are all connected to ground, so transistors 70-72 act as current mirrors. The relative currents through the transistors are determined by their respective gate sizes, and typically the sizes of transistor 70-72 will be much larger than the sizes of all transistors in IC 30 to maximize efficiency.

The drive current through the LEDs 12 is continuous unless the chip is disabled or the duty cycle drops to zero (Idim=Imax).

FIG. 5 provides examples of the waveforms at various nodes in the circuit of FIG. 3, previously described.

Accordingly, an LED driver IC 30 has been shown that sets the maximum current level using a single external resistor connected to a pin and controls the brightness level of the LEDs with a pulse train also coupled to the same pin.

Figure 6:
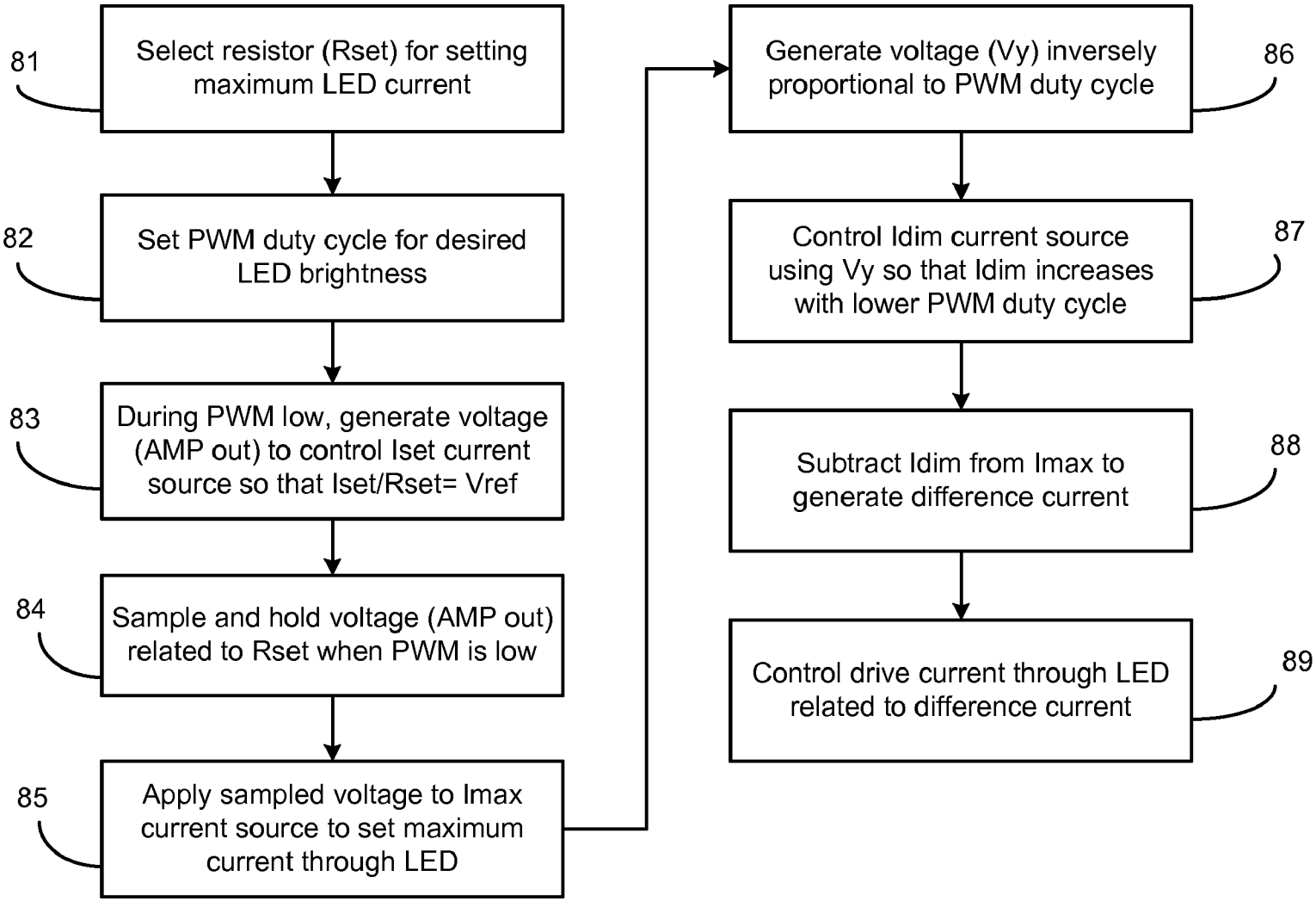
FIG. 6 is a flowchart showing various steps in the inventive technique.

FIG. 6 is a self-explanatory flowchart identifying steps 81-89, described above.

Although some circuit elements in FIGS. 3 and 4 are shown directly connected to each other, in an actual embodiment there may be intervening elements such as resistors and transistors for adjusting the magnitudes of the signals or conditioning the signals; however, the circuit elements in the figures are still considered to be electrically coupled to each other if they perform the same function as described. DC biasing circuitry may also be employed. The particular component values may be determined by simulation based on the requirements of the controller.

In another embodiment, with appropriate changes to the circuitry, the maximum current can be set when the PWM signal is high, and an increased PWM low time increases brightness. Such required changes in the circuitry are readily apparent to those skilled in the art.

Although the embodiments employ MOS transistors, other types or transistors, such as bipolar transistors, may be used.

Having described the invention in detail, those skilled in the art will appreciate that, given the present disclosure, modifications may be made to the invention without departing from the spirit and inventive concepts described herein. Therefore, it is not intended that the scope of the invention be limited to the specific embodiments illustrated and described.

What is claimed is:

1. A light emitting diode (LED) controller, enabling control of the maximum current through one or more LEDs and control of the brightness level of the one or more LEDs using only a single terminal, the controller comprising:

a first terminal for being connected to a pulse width modulation (PWM) source with a first resistance in series between the PWM source and the first terminal, a value of the first resistance setting a maximum current through one or more LEDs controlled by an output of the controller, a brightness level of the one or more LEDs being controlled by a duty cycle of the PWM source, the PWM source for generating a signal having first and second states;

the controller comprising a first circuit for setting a maximum current through the one or more LEDs, the first circuit comprising:

a first current source for generating a constant current controlling the maximum current through the one or more LEDs, the first current source having a control terminal;

a feedback circuit connected to the first terminal, the feedback circuit generating a control voltage for intermittent coupling to the first current source control terminal, wherein the control voltage is determined by the value of the first resistance;

a sample and hold circuit connected to the feedback circuit and to the first current source control terminal for intermittently coupling the control voltage from the feedback circuit to the first current source control terminal when the sample and hold circuit is triggered, the sample and hold circuit having a trigger circuit coupled to the first terminal such that the coupling only occurs when the PWM source generates a signal of the first state, whereby the first current source continues to generate the constant current controlling the maximum current through the one or more LEDs even when the PWM source generates a signal of the second state;

the controller having a second circuit for controlling a brightness level of the one or more LEDs based on the duty cycle of the PWM source, the second circuit comprising:

a dimmer control circuit connected to the first terminal for generating a dimmer control voltage related to the duty cycle of the PWM source;

a second current source having a control terminal coupled to the dimmer control voltage, a current generated by the second control source being related to the duty cycle of the PWM source;

the second current source being connected to the first current source to create a difference current at a node, such that a maximum duty cycle of the PWM source generates a maximum difference current, and a duty cycle below the maximum duty cycle reduces the difference current; and LED driver circuitry coupled to the node, wherein an increased difference current increases current generated by the driver circuitry, such that a maximum duty cycle of the PWM source generates a maximum current by the driver circuitry set by the value of the first resistance, and a duty cycle of the PWM source below the maximum duty cycle reduces the current generated by the driver circuitry to decrease a brightness of the one or more LEDs.

2. The controller of claim 1 wherein the controller is formed as a packaged integrated circuit chip, the first terminal being a pin on a package containing the chip.

3. The controller of claim 1 wherein the feedback circuit comprises:

a second current source having a control terminal;

a differential amplifier having a first input electrically coupled to the first terminal and a second input coupled to receive a voltage reference; and the second current source having a control terminal electrically coupled to an output of the amplifier, the second current source having a current handling terminal electrically coupled to the first terminal, so that the differential amplifier adjusts current generated by the second current source such that a voltage at the first terminal is substantial equal to the voltage reference when the PWM source outputs the first state.

4. The controller of claim 1 wherein the driver circuitry comprises a first transistor having a first current handling terminal connected to the node and a control terminal also connected to the node, the driver circuitry also comprising one or more current mirror transistors, each current mirror transistor having a control terminal connected to the control terminal of the first transistor, the one or more current mirror transistors being connected to respective terminals of the controller for being connected to one or more LEDs.

5. The controller of claim 1 wherein the sample and hold circuit comprises:

an inverter coupled to the first terminal;

a switch connected between the feedback circuit and the first current source control terminal;

a one-shot circuit triggered by an output of the inverter and connected to the switch for closing the switch for a predetermined period of time during the first state of the PWM source; and a capacitor connected to the first current source control terminal.

6. The controller of claim 1 wherein the dimmer control circuit connected to the first terminal for generating a dimmer control voltage related to the duty cycle of the PWM source comprises a low pass filter.

7. The controller of claim 1 wherein the first current source comprises a PMOS transistor with a current handling terminal connected to the node, the second current source comprises a first NMOS transistor with a current handling terminal connected to the node, and the driver circuitry comprises:

a second NMOS transistor having a current handling terminal connected to the node and a gate also connected to the node, the driver circuitry also comprising one or more NMOS current mirror transistors, each current mirror transistor having a gate connected to the gate of the second NMOS transistor, the one or more NMOS current mirror transistors being connected to respective terminals of the controller for being connected to one or more LEDs.

8. The controller of claim 1 wherein the controller is formed as a packaged integrated circuit chip, the first terminal being a pin on a package containing the chip, wherein the PWM source and the first resistance are external to the package.

9. The controller of claim 1 further comprising the PWM source and the first resistance.

10. The controller of claim 9 wherein the first resistance is a resistor.

11. The controller of claim 1 wherein the first state of the PWM source is a low state, the second state is a high state, and duty cycle is defined as a percentage of the second state time versus total time.

12. The controller of claim 1 wherein the first state of the PWM source is a high state, the second state is a low state, and duty cycle is defined as a percentage of the second state time versus total time.

13. A method of setting a maximum current through one or more light emitting diodes (LEDs) and controlling the brightness level of the one or more LEDs using only a single terminal, the method comprising:

generating a pulse width modulation (PWM) signal by a PWM source, a brightness level of one or more LEDs being controlled by a duty cycle of the PWM source, the PWM signal having first and second states;

setting a maximum current through the one or more LEDs, setting a maximum current comprising:

generating a constant first current by a first current source for controlling a maximum current through the one or more LEDs;

generating a control voltage by a feedback circuit connected to a first terminal, wherein the control voltage is determined by the value of a first resistance in series between the PWM source and the first terminal, the value of the first resistance setting a maximum current through the one or more LEDs;

intermittently coupling the control voltage, by a sample and hold circuit, to the first current source for setting the constant current of the first current source when the sample and hold circuit is triggered, such that the coupling only occurs when the PWM source generates a signal of the first state, whereby the first current source continues to generate the constant current controlling the maximum current through the one or more LEDs even when the PWM source generates a signal of the second state;

controlling a brightness level of the one or more LEDs based on the duty cycle of the PWM source, controlling the brightness level comprising:

generating a second current by a second control source related to the duty cycle of the PWM source;

subtracting the second current from the first current to create a difference current at a node, such that a maximum duty cycle of the PWM source generates a maximum difference current, and a duty cycle below the maximum duty cycle reduces the difference current; and controlling LED driver circuitry based on a magnitude of the difference coupled to the node, wherein an increased difference current increases current generated by the driver circuitry, such that a maximum duty cycle of the PWM source generates a maximum current by the driver circuitry set by the value of the first resistance, and a duty cycle of the PWM source below the maximum duty cycle reduces the current generated by the driver circuitry to decrease a brightness of the one or more LEDs.

14. The method of claim 13 wherein the first terminal is a pin on a package containing the first current source, the second current source, the feedback circuit, the sample and hold circuit, and the LED driver circuitry.

15. The method of claim 13 wherein generating a control voltage by a feedback circuit comprises adjusting current generated by the first current source such that a voltage at the first terminal is substantial equal to a voltage reference connected to a differential amplifier when the PWM source outputs the first state.

16. The method of claim 13 wherein intermittently coupling the control voltage, by a sample and hold circuit, to the first current source comprises:

inverting, by an inverter, a PWM signal coupled to the first terminal;

triggering a one-shot circuit by an output of the inverter to close a switch for a predetermined period of time during the first state of the PWM source, the switch being connected between the control voltage and the first current source; and holding the control voltage at a control terminal of the first current source by a capacitor when the switch is opened.

17. The method of claim 13 further comprising controlling the duty cycle of the PWM source to control a brightness of the one or more LEDs.

18. The method of claim 13 wherein generating a second current by a second current source related to the duty cycle of the PWM source comprises low pass filtering an inverse of the PWM signal and applying a filtered signal to a control terminal of the second current source.

19. The method of claim 13 wherein the first resistance is a resistor.

20. The method of claim 13 wherein the first state of the PWM source is a low state, the second state is a high state, and duty cycle is defined as a percentage of the second state time versus total time.

21. The method of claim 13 wherein the first state of the PWM source is a high state, the second state is a low state, and duty cycle is defined as a percentage of the second state time versus total time.

* * * * *